US009452606B2

(12) United States Patent
Yamada

(10) Patent No.: US 9,452,606 B2
(45) **Date of Patent: *Sep. 27, 2016**

(54) LIQUID EJECTION HEAD WITH OPENINGS HAVING ASYMMETRIC PROFILE

(71) Applicant: CANON KABUSHIKI KAISHA, Tokyo (JP)

(72) Inventor: Kazuhiro Yamada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/477,013

(22) Filed: Sep. 4, 2014

(65) Prior Publication Data

US 2015/0085017 A1 Mar. 26, 2015

(30) Foreign Application Priority Data

Sep. 24, 2013 (JP) ..... 2013-196837

(51) Int. Cl.
*B41J 2/155* (2006.01)
*B41J 2/14* (2006.01)

(52) U.S. Cl.
CPC ..... *B41J 2/155* (2013.01); *B41J 2/1433* (2013.01); *B41J 2202/11* (2013.01); *B41J 2202/20* (2013.01)

(58) Field of Classification Search
CPC ..... B41J 2202/07; B41J 2/19; B41J 2002/14169
USPC ..... 347/49, 56
See application file for complete search history.

(56) References Cited

U.S. PATENT DOCUMENTS 6,081,280 A * 6/2000 Bolash et al. ..... 347/9
6,328,423 B1 * 12/2001 Wong et al. ..... 347/50
6,796,019 B2 * 9/2004 Komplin et al. ..... 29/611

(Continued)

FOREIGN PATENT DOCUMENTS

CN 1442295 A 9/2003
CN 102036825 A 4/2011

(Continued)

OTHER PUBLICATIONS

Search Report in European Patent Application No. 14003238.4, dated Feb. 27, 2015.

(Continued)

*Primary Examiner* — Justin Seo
(74) *Attorney, Agent, or Firm* — Fitzpatrick, Cella, Harper & Scinto

(57) ABSTRACT

A liquid ejection head includes a plurality of ejection members, each having an ejection port for ejecting liquid, an element for ejecting a liquid from the ejection port, a liquid chamber for storing liquid to be supplied to the ejection port and a heater for heating liquid, and a base substrate bearing the plurality of ejection members arranged thereon and having a common flow channel for supplying liquid to the plurality of liquid chambers. The common flow channel communicates with the liquid chambers by way of respective branch ports and each of the branch ports is provided with a notch portion at the upstream side thereof as viewed in the flow direction of liquid flowing through the common flow channel and the upstream side of each of the branch ports has a profile asymmetric with regard to a straight line passing through the center of gravity of the branch port and extending in the flow direction.

18 Claims, 11 Drawing Sheets

(56) References Cited

U.S. PATENT DOCUMENTS

| | | | | |
|---|---|---|---|---|
| 6,979,077 | B2 | 12/2005 | Sakaida | |
| 7,600,855 | B2 | 10/2009 | Yagi et al. | |
| 8,579,412 | B2 | 11/2013 | Bibl et al. | |
| 8,789,924 | B2 | 7/2014 | Bibl et al. | |
| 8,789,928 | B2 | 7/2014 | Miyazaki | |
| 2005/0157091 | A1 | 7/2005 | Hu et al. | |
| 2006/0214986 | A1 | 9/2006 | Yagi et al. | |
| 2009/0096838 | A1* | 4/2009 | Chino et al. | 347/56 |
| 2010/0149283 | A1 | 6/2010 | Miyazaki | |
| 2010/0214359 | A1 | 8/2010 | Von Essen et al. | |
| 2011/0279548 | A1 | 11/2011 | Yamamoto et al. | |
| 2014/0227808 | A1 | 8/2014 | Miyazaki | |
| 2015/0085018 | A1* | 3/2015 | Yamada et al. | 347/42 |

FOREIGN PATENT DOCUMENTS

| | | | |
|---|---|---|---|
| CN | 103009813 | A | 4/2013 |
| EP | 1 338 420 | A1 | 8/2003 |
| JP | 03-297653 | A | 12/1991 |
| JP | 4729957 | B2 | 7/2011 |
| WO | 2009/143025 | A1 | 11/2009 |

OTHER PUBLICATIONS

Office Action in Chinese Patent Application No. 201410495493.0, dated Oct. 22, 2015.

Office Action in Russian Patent Application No. 2014138416, dated Mar. 21, 2016.

* cited by examiner

LIQUID EJECTION HEAD WITH OPENINGS HAVING ASYMMETRIC PROFILE

BACKGROUND OF THE INVENTION

1. Field of the Invention

The present invention relates to a liquid ejection head. More particularly, the present invention relates to a liquid ejection head that can suitably be utilized in the technological field of inkjet recording.

2. Description of the Related Art

Recording apparatus equipped with a liquid ejection head have recently been and are currently being used not only for home printer applications but also for business printer applications including commercial printer applications and retail photo printer applications. In short, the demand for such recording apparatus is expanding. High speed/high image quality recording performances are required to liquid ejection heads to be used for business printer applications. To meet the requirement, line heads that are liquid ejection heads having a width greater than the width of the recording mediums to be used with the liquid ejection head have been proposed and are getting popularity. In a line head, a large number of ejection ports from which liquid is ejected are arranged highly densely than ever. In general, a line head is formed by arranging a plurality of short recording element substrates on a base substrate having a considerable length.

Some line heads are formed by using a plurality of recording element substrates that adopt a thermal system or a shear-mode piezo system as liquid ejection system. As such a line head is driven for a high speed recording operation, the line head generates heat to a large extent so that the temperature of the recording element substrates is apt to rise high. As the temperature of the recording element substrates rises, the temperature of the liquid contained in the inside also rises to change the viscosity of the liquid to by turn change the quantity of liquid droplets that the line head ejects in the same image recording operation. In this way, the ejection characteristics of the line head are affected by temperature changes. Additionally, temperature differences can arise among the recording element substrates. Generally, liquid is supplied to each of the recording element substrates through a common flow channel that is formed within the head. Then, liquid that is heated at the upstream side flows down to the downstream side to give rise to temperature differences among the recording element substrates. Such temperature differences by turn can result in an image that represents irregularities in the width direction. When the temperature of a single recording element substrate is forced to fluctuate with time to a large extent, on the other hand, the produced image can represent irregularities in the recording medium feeding direction. Commercial printer applications require a high recording speed and an image quality above a certain quality level at the same time. Therefore, how to reduce such temperature differences of liquid is an important problem that needs to be dissolved.

Japanese Patent Publication No. 4,729,957 describes a line head including spacer members arranged on a base substrate so as to support respective recording element substrates. Each of the spacer members has a liquid chamber formed in the inside thereof. The spacer members are provided for the purpose of improving the easiness of replacing defective recording element substrates and absorbing the differences in the thickness among some component members. When the structure of such a line head is examined from the viewpoint of heat emission, the heat emitted from each of the recording element substrates is less easily conducted to the base substrate because of the spacer member interposed between the recording element substrate and the base substrate. Therefore, thermal interferences among the recording element substrates via the base substrate are suppressed. Thus, the temperature of each of the recording element substrates does not depend on the position where it is arranged on the base substrate but depends on the ratio of the quantity of heat it generates to the quantity of liquid it ejects, its printing duty and its temperature control means, which may typically be so-called sub-heaters. Then, temperature differences seldom arise among the recording element substrates so that image irregularities in the width direction will effectively be suppressed.

However, with the arrangement described in Japanese Patent Publication No. 4,729,957, when a recording element substrate is subjected to a temperature control operation by means the temperature control means thereof, which may typically be sub-heaters, in a recording standby status, for example, the temperature of the recording element substrate transitionally rises at the time of starting an image recording operation. Then, as a result, image irregularities arise immediately after the start of the recording operation. This is because the temperature of the liquid in the liquid chamber in the corresponding spacer member is raised by the heat generated by the temperature control means in a recording standby status during the temperature control operation so that consequently the heated liquid is supplied to the recording element substrate when the recording operation is started. Such a transitional temperature rise does not take place if no temperature control operation is conducted in a recording standby status. However, in the case of thermal systems and shear-mode piezo systems, the temperature of a recording element substrate can get to 50° C. in a high duty continuous image recording operation. Therefore, temperature control in a recording standby status is necessary because otherwise the temperature rise at the time of starting an image recording operation is so high as to give rise to image irregularities immediate after the start of the recording operation.

SUMMARY OF THE INVENTION

In view of the above-identified problems of the prior art, therefore, the object of the present invention is to provide a liquid ejection head that can suppress irregularities of the image that is recorded after a recording standby status, during which a temperature control operation is conducted, by efficiently stirring the liquid in the liquid chambers.

According to the present invention, the above object is achieved by providing a liquid ejection head including: a plurality of ejection members, each having an ejection port for ejecting liquid, an energy generating element for generating energy to be utilized to eject liquid from the ejection port, a liquid chamber for storing liquid to be supplied to the ejection port and a heater; and a base substrate bearing the plurality of ejection members arranged thereon and having a common flow channel for supplying liquid to the plurality of liquid chambers, wherein the common flow channel communicates with the liquid chambers by way of respective branch ports and each of the branch ports is provided with a first notch portion at an upstream side thereof as viewed in the flow direction of liquid flowing through the common flow channel.

Further features of the present invention will become apparent from the following description of exemplary embodiments with reference to the attached drawings.

DESCRIPTION OF THE EMBODIMENTS

Now, a preferred embodiment of the present invention will be described below by referring to the accompanying drawings. Note, however, that the scope of the present invention is defined only by the appended claims. In other words, the following description of the embodiment by no means limits the scope of the present invention. For example, the shapes, the positional arrangements and so on that are described below do not limit the scope of the present invention by any means. Similarly, while the embodiment that is described below employs recording element substrates that are based on a thermal system, liquid ejection means that are applicable to the present invention are not limited to a thermal system and recording embodiment substrates that are based on a piezo system can also be used for the purpose of the present invention.

Figure 1:
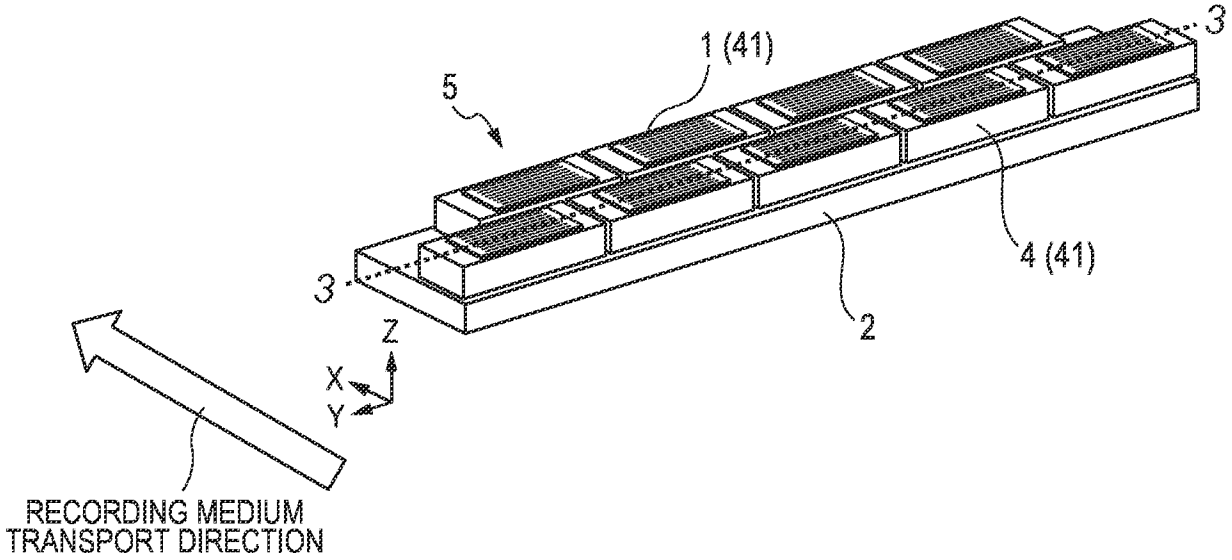
FIG. 1 is a schematic perspective view of an embodiment of liquid ejection head according to the present invention.

FIG. 1 is a schematic perspective view of an embodiment of liquid ejection head according to the present invention, which is a line head in which recording element substrates are arranged in a zigzag manner. The liquid ejection head 5 includes a plurality of ejection members 41 and a base substrate 2. According to this embodiment, an ejection member 41 is formed by a recording element substrate 1 and a support member 4. Thus, the recording element substrates 1 are arranged individually on the respective support members 4. The ejection members 41 are arranged on the base substrate 2 in a zigzag manner. Note that, in the liquid ejection head 5 of this embodiment, the plurality of recording element substrates 1 are arranged in the longitudinal direction of the liquid ejection head 5 and the positions of the recording element substrates are alternatively shifted in the lateral direction of the liquid ejection head such that the recording element substrates are arranged in a zigzag manner as viewed in the longitudinal direction of the liquid ejection head 5. However, the recording element substrates 1 do not necessarily need to be arranged in a zigzag manner. For example, a positional arrangement where recording element substrates having a parallelogrammic or trapezoidal profile are linearly disposed or a positional arrangement where recording element substrates are obliquely disposed at a certain angle relative to the longitudinal direction of the base substrate 2 may alternatively be adopted.

Figure 2A:
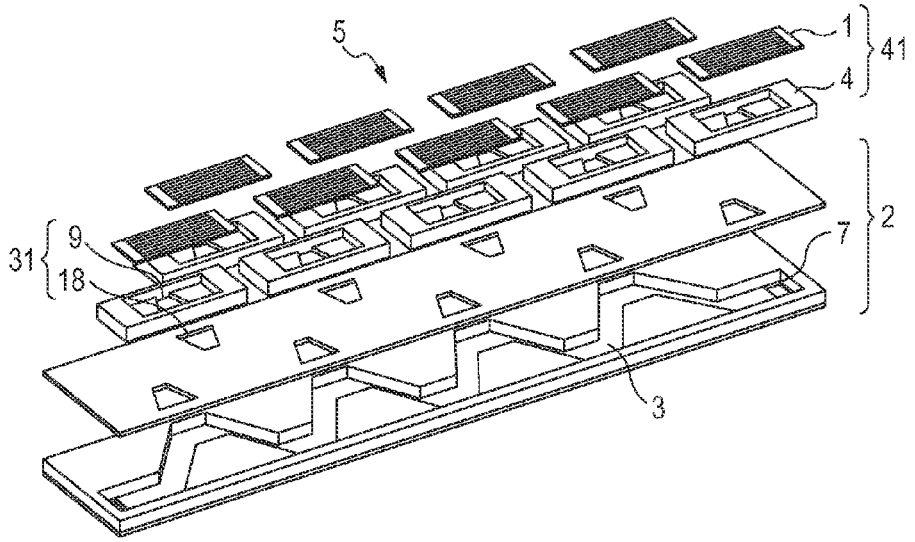
FIGS. 2A, 2B and 2C are exploded schematic perspective views of the liquid ejection head of FIG. 1.
Figure 2B:
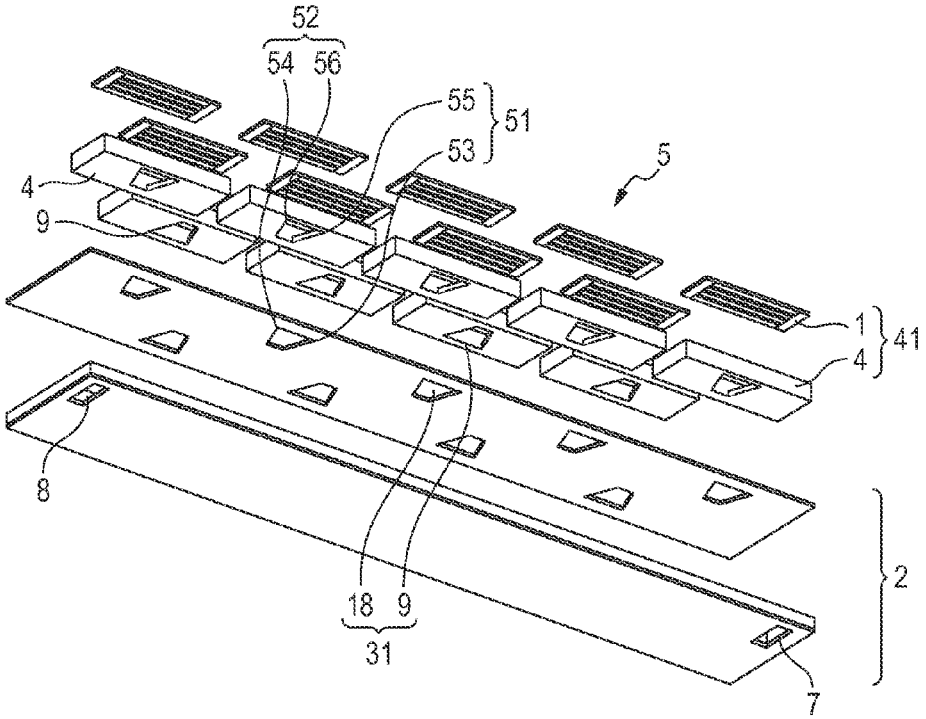
Figure 3A:
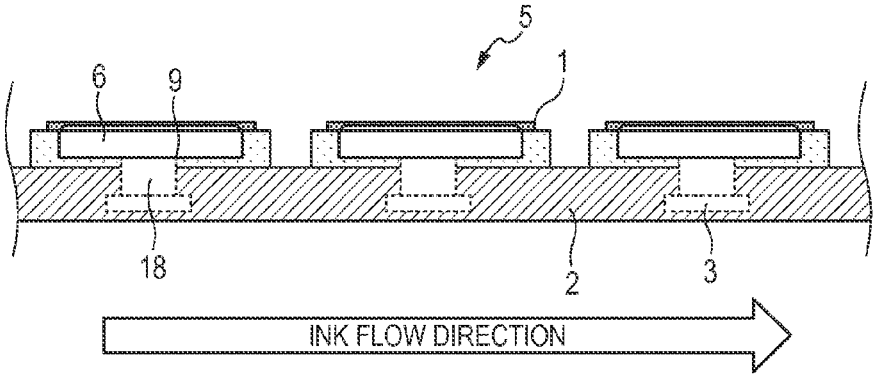
FIGS. 3A and 3B are schematic cross sectional views of a part of the liquid ejection head of FIG. 1 taken along line 3-3 in FIG. 1.

FIG. 2A is an exploded schematic perspective view of the liquid ejection head 5 of FIG. 1 as viewed from the side of the recording element substrates 1 and represents the internal structure of the base substrate 2. FIG. 2B is an exploded schematic perspective view of the liquid ejection head of FIG. 1 as viewed from the side of the base substrate 2. FIG. 3A is a schematic cross sectional view of a part of the liquid ejection head of FIG. 1 taken along line 3-3 in FIG. 1.

A common flow channel 3 through which liquid flows, an inflow port 7 for allowing liquid to flow into the common flow channel 3 and an outflow port 8 for allowing liquid to flow out from the common flow channel 3 are formed in the base substrate 2. A liquid chamber 6 for storing liquid to be supplied to the liquid supply port 14 (see FIG. 5) of a corresponding recording element substrate 1 is formed in each of the support members 4. The common flow channel 3 communicates with the liquid chamber 6 of each of the support members 4 by way of a branch port 31. In each of the branch ports 31, a first branch port notch portion 51 is formed at the upstream side as viewed in the flow direction of liquid that flows through the common flow channel 3, whereas a second branch port notch portion 52, which is separate from the first branch port notch portion 51, is formed at the downstream side.

Each of the branch ports 31 includes a distribution port 18, which is an opening formed in the base substrate 2, and an introduction port 9, which is an opening formed in the corresponding support member 4 and communicates with the distribution port 18. In the distribution port 18, a first distribution port notch portion 53, which operates as part of the first branch port notch portion 51, is formed at the upstream side of the opening thereof as viewed in the flow direction of liquid that flows through the common liquid path 3, whereas a second distribution port notch portion 54, which operates as part of the second branch port notch portion 52, is formed at the downstream side of the opening thereof. Similarly, in the introduction port 9, a first introduction port notch portion 55, which operates as part of the first branch port notch portion 51, is formed at the upstream side as viewed in the flow direction of liquid that flows through the common liquid path 3, whereas a second introduction port notch portion 56, which operates as part of the second branch port notch portion 52, is formed at the downstream side. Each of the notch portions has a part provided with an oblique portion that makes the upstream side profile or the downstream side profile of the opening run neither in parallel with nor perpendicularly relative to the liquid flow direction.

Figure 3B:
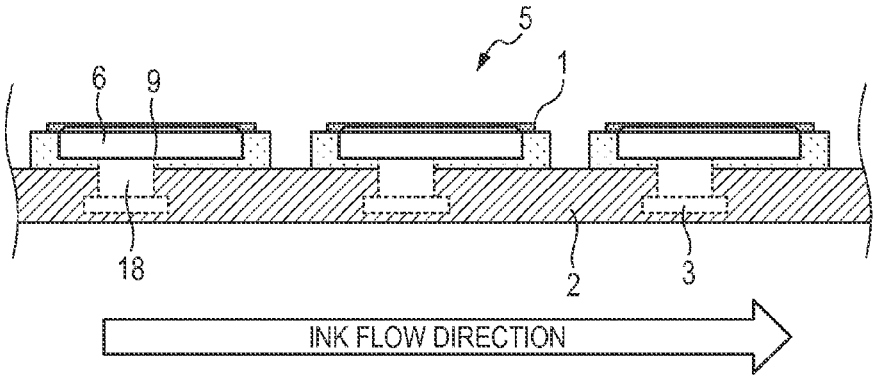

In the instance of FIGS. 2A and 2B, the introduction ports 9 and the distribution ports 18 are so arranged as to be located respectively at the center positions of the respective liquid chambers 6 as viewed in the longitudinal direction of the liquid chambers 6 as illustrated in FIG. 3A. However, the introduction ports 9 and the distribution ports 18 may alternatively be arranged at respective positions that are offset toward the upstream side of the liquid chambers 6 as illustrated in FIG. 3B if the desired effects can be obtained by arranging those ports at the upstream side. When the liquid ejection head is filled with ink, bubbles are apt to remain at the upstream side in each of the liquid chambers 6 than at the downstream side. However, the quantity of residual bubbles will be reduced at the upstream side with the arrangement of FIG. 3B.

With regard to each of the recording element substrates 1 and the corresponding support member 4, the liquid chamber 6 and the introduction port 9 are formed such that the width of the liquid chamber 6 and that of the introduction port 9 substantially agree with each other in the lateral direction of the recording element substrate 1. While the contour of the introduction port 9 and that of the distribution port 18 do not necessarily have to be the same as or similar to each other, at least the notch portions 55 and 56 of the introduction port 9 and the notch portions 53 and 54 of the distribution port 18 are respectively located preferably close to each other and more preferably at overlapping positions.

Each of the recording element substrates 1 is provided with heat generators 13 (see FIG. 5) that are energy generating elements for generating energy to be utilized to eject liquid. This will be described in greater detail hereinafter. The support members 4 have a function of hardly conducting the heat generated in the recording element substrates 1 to the base substrate 2 and the liquid in the common flow channel 3. Therefore, the temperature difference of the liquid in the common flow channel 3 is minimized between the upstream end and the downstream end. In other words, the line head is made to represent a subsequently uniform temperature as a whole and hence can record high quality images that are practically free from irregularities. From this point of view, preferably, the support members 4 are made of a material representing a low thermal conductivity such as resin and, at the same time, each of the introduction ports 9 is not made to represent a large opening relative to the contact area of the corresponding liquid chamber 6 and the base substrate 2. If the introduction port 9 is made to represent a large opening, the quantity of heat that is conducted from the corresponding recording element substrate 1 to the common flow channel 3 by way of liquid increases. Then, as a result, the temperature difference between the recording element substrates 1 located at the downstream side of the common flow channel 3 and the recording element substrates 1 located at the upstream side increases.

Figure 2C:
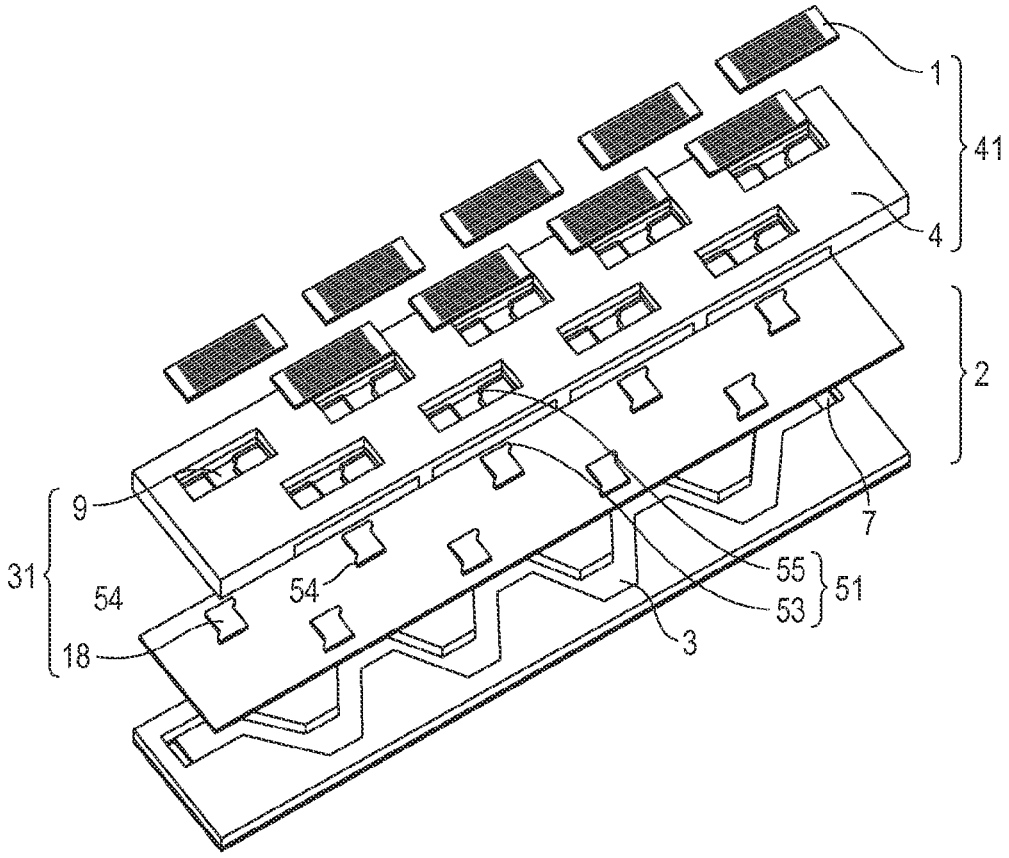

When the thermal conductivity in the directions running along the main surface of each support member 4 can be made low, one or more support members 4, which or each of which, whichever appropriate, commonly supports a plurality of recording element substrates 1 as illustrated in FIG. 2C, may alternatively be employed. In that case, the number of components can be reduced, which is favorable.

The thermal resistance of the support members 4 between the recording element substrates 1 and the common flow channel 3 is preferably not less than 2.5 (K/W). With such an arrangement, as the recording element substrates 1 generate heat to a large extent in a high speed high duty image recording operation, the ratio of the quantity of heat that is conducted to the liquid in the common flow channel 3 relative to the total quantity of heat that is generated falls. Thus, the quantity of heat that is conducted from the recording element substrates 1 to the base substrate 2 by way of the support members 4 is satisfactorily suppressed when the thermal resistance of the support members 4 is made to be not less than 2.5 (K/W). Then, most of the heat generated from the recording element substrates 1 is transferred to the liquid in the recording element substrates 1 and dissipated to the outside as liquid is ejected from the recording element substrates 1. With the above-described arrangement, the heat transfer efficiency between the recording element substrates 1 and the liquid ejected from them rises in a high speed high duty image recording operation because the quantity of ejected liquid increases. Therefore, if the quantity of heat generated from the recording element substrates 1 increases, dissipation of heat by way of ejected liquid is accelerated at the same time. The net result will be that the quantity of heat that is transferred from the recording element substrates 1 to the base substrate 2 remains invariable or decreases. Line heads generally generate heat to a large extent because they include a large number of ejection ports for ejecting liquid. However, with the above-described arrangement, if the liquid ejection head 5 generates heat to a large extent in a high speed high duty operation, the quantity of heat that is transferred to the liquid circulating through the common flow channel 3 is suppressed to a low transfer level. Then, since the circulating liquid represents little temperature changes, this arrangement provides advantages that both the temperature control tank and the cooler of the recording apparatus main body are not required to have a large heat exchange capacity and allow a large electric power consumption rate.

If the recording element substrates 1 and the base substrate 2 represent a large difference of linear expansibility, the support members 4 can come off to give rise to liquid leaking spots when they are heated in the adhesive setting step of the line head manufacturing process particularly when the line head has a long length. Therefore, preferably, the support members 4 are made of a material that represents a small thermal conductivity and the difference of linear expansibility from the recording element substrates 1 and the base substrate 2 is small. Examples of preferable materials to be used for the support members 4 include resin materials, particularly low linear expansibility composite materials prepared by using PPS (polyphenyl sulfide) or PSF (polysulfone) as base material and adding an inorganic filler material such as silica fine particles to the base material.

The base substrate 2 is preferably made of a material representing a relatively low thermal expansion coefficient. Additionally, the base substrate 2 desirably has a rigidity that does not allow the liquid ejection head 5, which is a line head, to warp and represents a sufficient degree of corrosion resistance against the liquid. A suitable example of such a material is alumina. While the base substrate 2 may be formed by using a single plate-shaped member, the use of a laminate of a plurality of thin alumina layers is preferable because a three-dimensional fluid path can be formed in the inside of the base substrate 2 that is made of such a laminate as illustrated in FIG. 2A.

Figure 4:
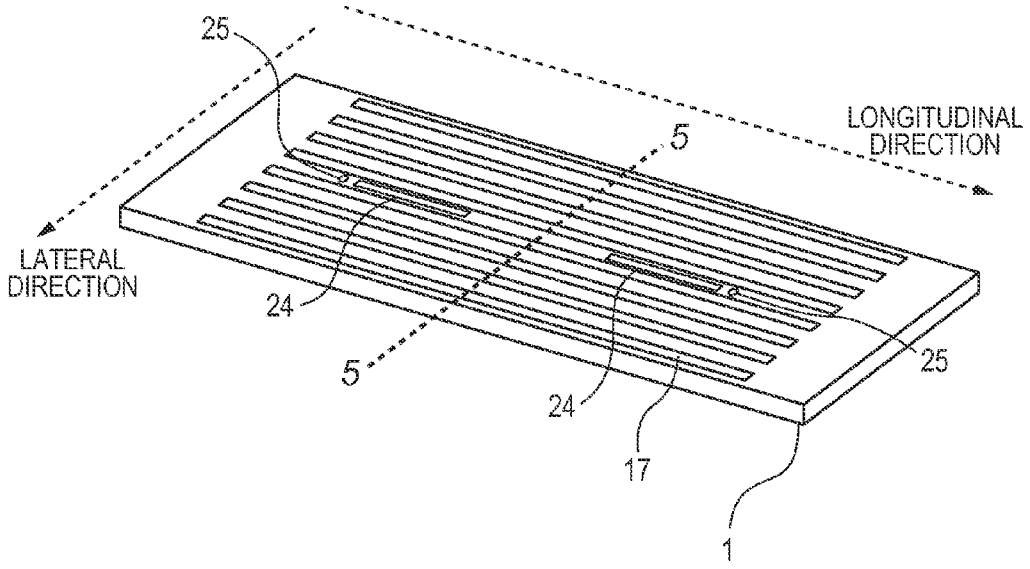
FIG. 4 is a schematic perspective view of a recording element substrate that can be used for the embodiment of FIG. 1.
Figure 5:
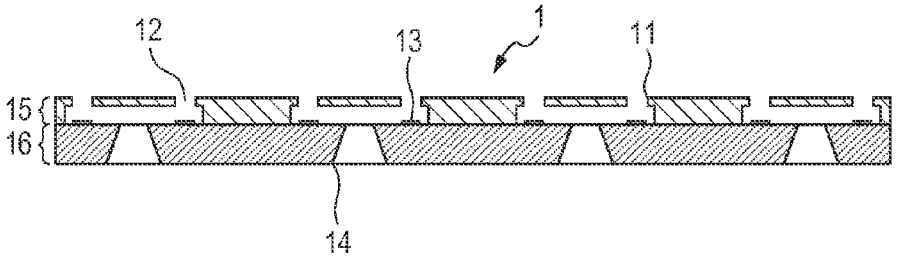
FIG. 5 is a schematic cross sectional view taken along line 5-5 in FIG. 4.

Now, the structure of the recording element substrates 1 will be described below. FIG. 4 is a schematic perspective view of a recording element substrate 1 and FIG. 5 is a schematic cross sectional view of the recording element substrate taken along line 5-5 in FIG. 4. In this embodiment, a total of eight ejection port rows 17, each having a plurality of ejection ports 11, are formed. While a single ejection port row 17 apparently forms a single opening in the illustration of FIG. 4, a plurality of ejection ports 11 are arranged side by side to form a single ejection port row 17 in reality.

The recording element substrate 1 is based on a thermal system for ink ejection and designed to eject ink by means of heat generators 13. The recording element substrates 1 is formed by an ejection port forming layer 15 and a heater board 16. A plurality of ejection ports 11 and so many foaming chambers 12, which are provided to correspond to the respective ejection ports 11, are arranged in the ejection port forming layer 15. Longitudinally extending liquid supply ports 14 for supplying liquid to the foaming chambers 12 and heat generators 13 are formed in the heater board 16. In this embodiment, a liquid supply port 14 is provided for two ejection port rows 17. In other words, a total of four liquid supply ports 14 are arranged in this embodiment. As described above, the liquid supply ports 14 communicate with the liquid chamber 6 of the corresponding support members 4.

Electric wiring (not illustrated) is provided in the inside of the heater board 16. The electric wiring is electrically connected to the lead electrode of an FPC (flexible circuit substrate) (not illustrated) arranged on the base substrate 2 or the electrode (not illustrated) arranged in the base substrate 2. As a pulse voltage is input to the heater board 16 from the external control circuit (not illustrated) arranged in the recording apparatus main body by way of the electrode, the heat generators 13 are heated to boil the liquid in the foaming chambers 12. Then, liquid droplets are ejected from the ejection ports 11.

Sub-heaters 24 and temperature sensors 25 that are temperature control means are arranged in the inside of the heater board 16 and electrically connected to the FPC and also to the control circuit of the recording apparatus main body. The output signals from the temperature sensors 25 are transmitted to the control circuit by way of the FPC. When the output values of the temperature sensors are lower than the preset target temperature, the control circuit drives the sub-heaters 24, which are heating means, to heat the recording element substrate 1. As the output values of the temperature sensors rise above the target temperature, the control circuit stops the heating operation of the sub-heaters 24. Since the thermal conductivity of the support member 4 of this embodiment is low, the temperature of the recording element substrate 1 easily rises above the target temperature due to the heat that is generated as a result of ejection of liquid in a high duty image recording operation. Then, the heating operation of the sub-heaters is stopped. Meanwhile, since the recording element substrate 1 does not operate to eject liquid during recording standby, the sub-heaters 24 are driven to operate for temperature control. One or more than one sub-heaters 24 may be provided in a recording element substrate 1. If two or more than two sub-heaters 24 are provided, they may be designed to be driven independently or in an interlocked manner for a temperature control operation. With the arrangement illustrated in FIG. 4, two sub-heaters 24 are formed in a recording element substrate 1 and each of the sub-heaters 24 is driven for a temperature control operation according to the output value of the temperature sensor 25 that is located at a position closest to the sub-heater 24. With this arrangement, for example, when a half of the recording element substrate 1 is driven for a high duty image recording operation, while the remaining half of the recording element substrate 1 is left inactive and does not eject liquid at all, the liquid non-ejecting region and its vicinity whose temperature becomes relatively low can be locally heated to realize a uniform temperature distribution within the recording embodiment substrate 1.

While an arrangement of providing one or more than one sub-heaters 24 as temperature control means is described above, alternatively, heat generators 13 arranged in the foaming chambers 12 may be driven to an extent of not causing liquid to be ejected for the purpose of heating the recording element substrate 1.

Figure 6:
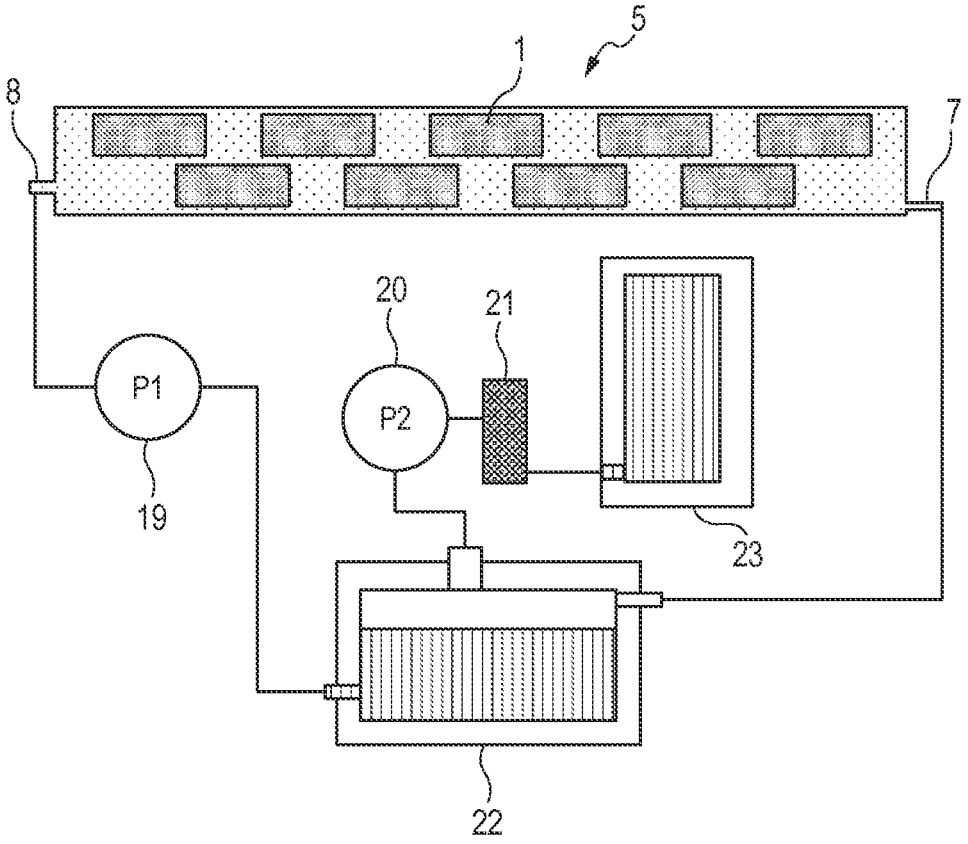
FIG. 6 is a schematic illustration of an exemplary liquid circulation system that can be used for the purpose of the present invention.

As illustrated in FIG. 6, a temperature control tank 22, a circulation pump 19, a feed pump 20, a filter 21, a liquid tank 23 and so on are provided in a recording apparatus that includes a liquid ejection head 5 according to the present invention. In the liquid ejection head 5, the inflow port 7 for supplying liquid to the common flow channel 3 is linked to a tube that communicates with the temperature control tank 22, while the outflow port 8 for flowing liquid out of the common flow channel 3 is linked to another tube that communicates with the circulation pump 19.

As the liquid ejection head 5 is driven, the circulation pump 19 is put into operation to circulate the liquid in the common flow channel 3. The temperature control tank 22 is linked to a heat exchanger (not illustrated) so that it can be subjected to heat exchange operations. The temperature control tank 22 has a function of supplying liquid to the liquid ejection head 5 and at the same time maintaining the temperature of the liquid that circulates through the circulation pump 19 to a constant temperature level. Additionally, the temperature control tank 22 is provided with a hole (not illustrated) for communicating with the open air. In other words, the temperature control tank 22 additionally has a function of expelling bubbles in the liquid in the tank to the outside. The temperature of the liquid flowing out from the outflow port 8 is controlled and regulated by the temperature control tank 22 before the liquid is directed toward the inflow port 7 and hence the temperature of the liquid located at the position of the inflow port 7 can always be held within a certain temperature range. When the temperature of the recording element substrates 1 is too high, the target temperature for the temperature control operation of the temperature control tank 22 may be lowered so as to supply liquid to the liquid ejection head 5 at a relatively low temperature.

The feed pump 20 can transfer liquid from the liquid tank 23 that stores liquid to the temperature control tank 22 after removing the foreign objects contained in the liquid by means of the filter 21 so as to supply liquid to the temperature control tank 22 for the liquid consumed by the liquid ejection head 5 as a result of an image recording operation.

Now, the arrangement of providing the branch port 31 with the first and second branch port notch portions 51 and 52, which characterizes the present invention in an aspect, will be described below by referring to FIGS. 7A through 7F, 8A through 8D, 9A and 9B. Note that the support member 4 having the introduction port 9, which the branch port 31 includes, will be described first for the purpose of easy understanding of the profile of the branch port 31. Also note that the distribution port 18 will not be described below because it has a profile substantially the same as the profile of the introduction port 9.

FIGS. 7A through 7F and 8A through 8D are schematic illustrations of exemplary profiles that the introduction port 9 can selectively take. FIGS. 7A, 7C, 7E, 8A and 8C are schematic perspective views of support member 4, illustrating the exemplary profiles thereof as viewed from the side of the recording element substrate 1. FIGS. 7B, 7D, 7F, 8B and 8D are schematic perspective views of support member 4, illustrating the exemplary profiles illustrated in FIGS. 7A, 7C, 7E, 8A and 8C as viewed from the side of the base substrate 2. FIGS. 9A and 9B are schematic views of introduction port 9, illustrating other exemplary profiles thereof. More specifically, FIG. 9A is a schematic perspective view of support member 4 as viewed from the side of the base substrate 2 and FIG. 9B is a schematic perspective view of support member 4 as viewed from the recording element substrate 1. Note that FIG. 9B represents the internal structure of the support member 4 by broken lines.

Figure 7A:
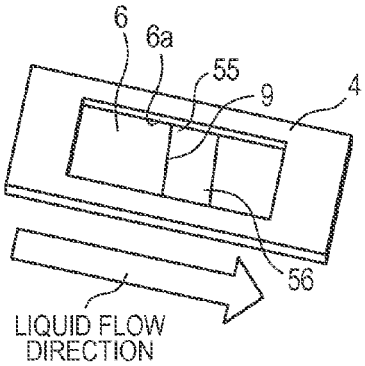
FIGS. 7A, 7B, 7C, 7D, 7E and 7F are schematic views of exemplary introduction ports that can be used for the purpose of the present invention.
Figure 7B:
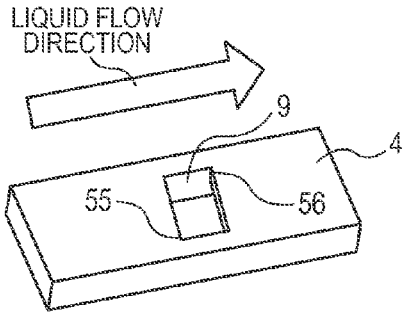
Figure 7C:
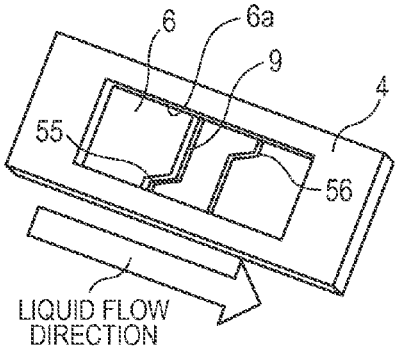
Figure 7D:
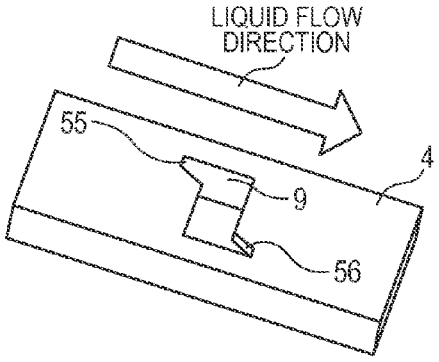
Figure 7E:
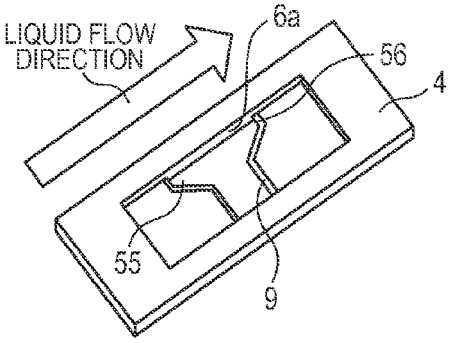
Figure 7F:
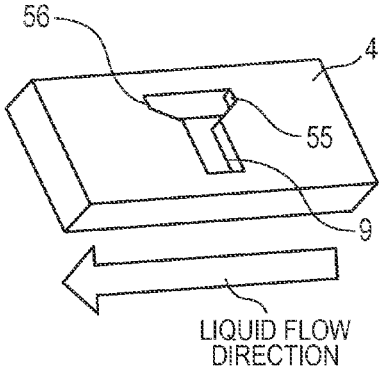
Figure 8A:
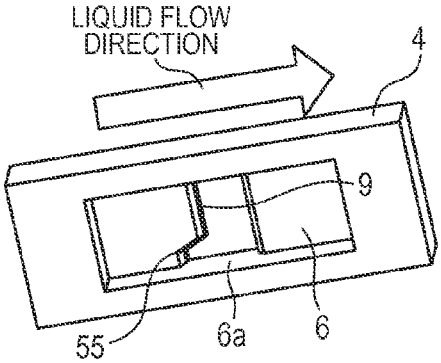
FIGS. 8A, 8B, 8C and 8D are schematic views of other exemplary introduction ports that can also be used for the purpose of the present invention.
Figure 8B:
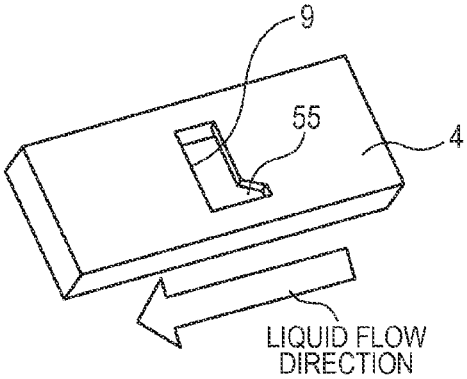
Figure 8C:
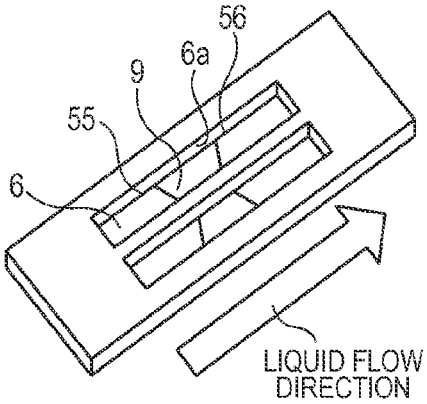
Figure 8D:
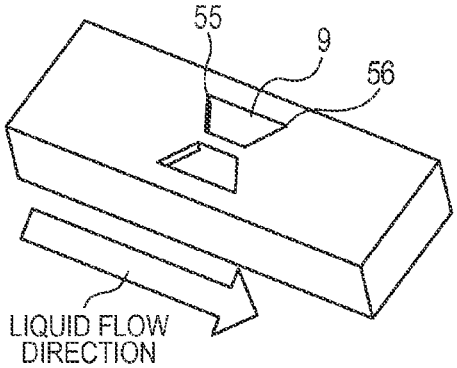
Figure 9A:
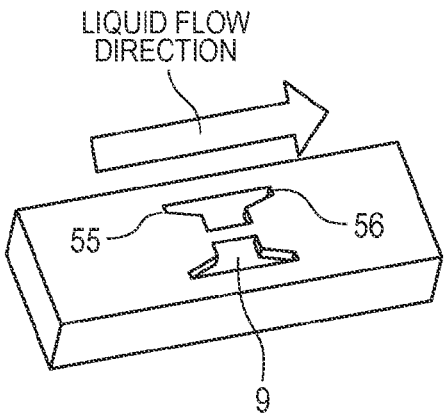
FIGS. 9A and 9B are schematic views of still other exemplary introduction ports that can be used for the purpose of the present invention.
Figure 9B:
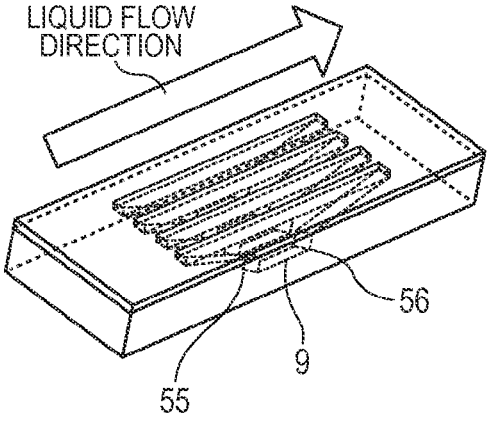

FIGS. 7A through 7F, 8A and 8B illustrates arrangements where a single liquid chamber 6 is formed in a single support member 4, whereas FIGS. 8C, 8D and 9A illustrates arrangements where two liquid chambers are formed in a single support member 4. FIG. 9B illustrates an arrangement where a total of four liquid chambers 4 are formed in a single support member 4.

Arrangements of forming a plurality of liquid chambers in a single support member 4 provide an advantage that the recording element substrate 1 and the support member 4 can have a large contact area to ensure a high degree of adhesion between the recording element substrate 1 and the support member 4 and minimize the risk of liquid leakage through the interface. On the other hand, the arrangements are accompanied by a disadvantage that each of the liquid chambers 6 inevitably has a small size and hence bubbles can remain in the liquid chambers 6 when they are filled with liquid. In other words, no problem arises if two or more than two liquid chambers are formed in a single support member 4 provided that there is no risk of remaining bubbles. FIG. 9B illustrates an arrangement of forming four liquid chambers 6 in a single support member 4. Such an arrangement can also be adopted for the purpose of the present invention.

In the support member 4 whose exemplary profiles are illustrated in FIGS. 7A through 7F, 8A through 8D and 9A, the liquid chambers 6 represent a rectangular cross section as viewed in the longitudinal direction and have a shape of a rectangular parallelepiped. However, the liquid chambers 6 do not necessarily have a shape of a rectangular parallelepiped. In other words, the liquid chambers 6 may alternatively represent a substantially triangular cross section as illustrated in FIG. 9B or a trapezoidal cross section as viewed in the longitudinal direction.

According to the present invention, each of the branch ports 31 is provided with the first and second branch port notch portions 51 and 52 (see FIGS. 2A through 2C) in order to make the branch port 31 have a function of producing swirling currents in the liquid chamber 6 to effectively stir the liquid in the liquid chamber 6, by exploiting the power of the liquid flowing through the common flow channel 3 as drive force in a recording standby status where a temperature control operation is conducted. This function can suppress the unevenness of temperature distribution, if any, in the liquid in the liquid chamber 6.

Firstly, the first and second branch port notch portions 51 and 52 will be described below by referring to the first and second introduction port notch portions 55 and 56.

As illustrated in FIGS. 7A through 7F, 8A through 8D, 9A and 9B, there are a variety of different profiles that can selectively be employed for the first and second introduction port notch portions 55 and 56. In the above-identified drawings, the first and second introduction port notch portions 55 and 56 are formed at least at the upstream side of the introduction port 9 as viewed from the liquid flowing through the common flow channel 3 so as to be asymmetric relative to the center line of the common flow channel 3 running along the flow direction of liquid. More specifically, the opening of the introduction port 9 at least at the upstream side represents a profile that is asymmetric relative to the straight line that passes through the center of gravity of the opening and runs along the flow of liquid. Preferably, the first and second introduction port notch portions 55 and 56 are arranged respectively at either end of the introduction port 9 as viewed in the direction perpendicular to the flow direction of liquid running through the common flow channel 3.

As illustrated in FIGS. 8A and 8B, the introduction port 9 may not necessarily be provided with the second introduction port notch portion 56. However, from the viewpoint of the advantages of the present invention, the introduction port 9 may preferably be provided with the second introduction port notch portion 56 as illustrated in FIGS. 7A through 7F, 8C, 8D, 9A and 9B. The first and second introduction port notch portions 55 and 56 may have respective profiles that are different from each other so long as such different profiles can maximize the intended effect.

For the purpose of the present invention, "notch portions" may be produced by partly notching (forming a cutout portion at) the introduction port 9 at the upstream side and at the downstream side as viewed in the flow direction of liquid flowing through the common flow channel 3. Alternatively, "notch portions" may be produced by making the introduction port 9 wholly inclined both at the upstream side and at the downstream side as viewed in the flow direction of liquid flowing through the common flow channel 3.

Preferably, the first introduction port notch portion 55 has a part which is an extension of the lateral wall 6*a* of the liquid chamber 6 because, with such an arrangement, the liquid chamber 6 can be filled with liquid without any residual bubbles. This is because, when the liquid introduced into the liquid chamber 6 from the common flow channel 3 gets to the introduction port 9, the first introduction port notch portion 55 forms a liquid flow path that guides the liquid to the lateral wall 6*a* of the liquid chamber 6 and makes the liquid reach the bottom of the liquid chamber 6. Once such a liquid flow path is established, liquid will preferentially flow through the established flow path so that the liquid chamber 6 will be filled with liquid from the bottom thereof. Then, a situation where the introduction port 9 is blocked by liquid to leave residual bubbles in the liquid chamber 6 will effectively be prevented from taking place. Similarly, the second introduction port notch portion 56 also preferably has a part which is an extension of the lateral wall 6*a* of the liquid chamber 6. With such an arrangement, when liquid flows out from the liquid chamber 6 into the common flow channel 3, the fluid can flow from the second introduction notch portion 56 into the common flow channel 3 along the lateral wall 6*a* of the liquid chamber 6.

As for the positional relationship between the first introduction port notch portion 55 and the second introduction port notch portion 56, they may be arranged at the same position on the upstream and downstream sides respectively as viewed in a direction orthogonal relative to the flow direction of liquid flowing through the common flow channel 3 as illustrated in FIGS. 7E, 7F, 8C, 8D, 9A and 9B. Alternatively, the first and second introduction port notch portions 55 and 56 may be arranged at opposite positions on the upstream and downstream sides respectively with regard to the center line that runs in parallel with the flow direction of liquid flowing through the common flow channel 3. The latter arrangement is preferable because the effects and the advantages of the present invention, which will be described below, can be maximized.

Figure 10:
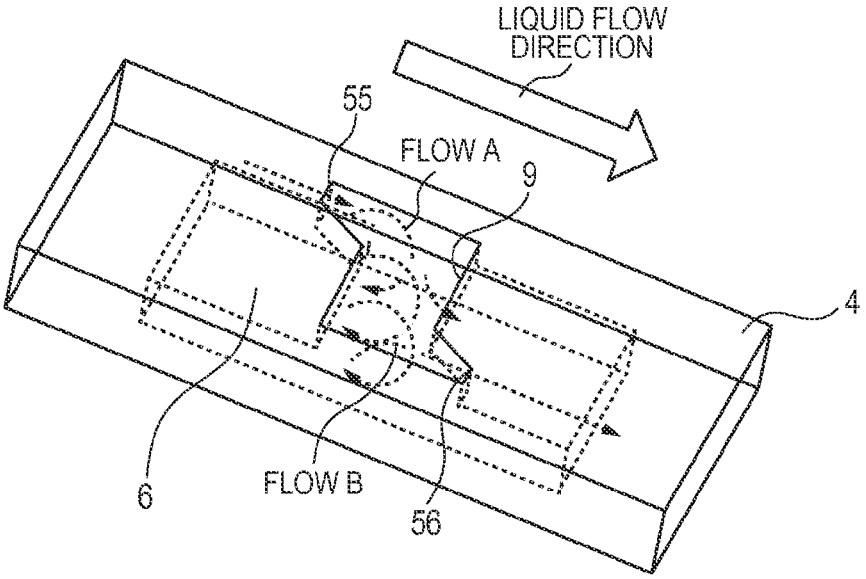
FIG. 10 is a schematic illustration of the flow of liquid in a liquid chamber.

Now, the effects of the first branch port notch portion 51 and the second branch port notch portion 52 will be described in detail by referring to FIG. 10. Like the preceding description, the effects will be described by way of the support member 4 having the introduction port 9. FIG. 10 is a schematic illustration of the flow of liquid in the liquid chamber 6, which can be observed when the support member 4 of FIGS. 7C and 7D is employed. Note that FIG. 10 illustrates the support member 4 as viewed from the side of the base substrate 2 and that the liquid chamber 6 in the inside of the support member 4 is indicated by broken lines for the purpose of the flow of liquid being easily recognized. Also note that the arrow in FIG. 10 indicates the flow of liquid in a recording standby status where a temperature control operation is conducted.

As illustrated in FIG. 10, part of the liquid that flows through the common flow channel 3 and gets to the first introduction port notch portion 55 forms a flow that intrudes into the liquid chamber 6 from the first introduction port notch portion 55 (intruding flow). The intruding flow actually forms liquid flow (the first flow) A that runs along the lateral wall 6*a* of the liquid chamber 6 toward the bottom of the liquid chamber 6 (and hence the part thereof located at the side of the recording element substrate 1) due to capillary force and gravitation so as to collide with the bottom and then is directed toward the upstream side in terms of the liquid flow flowing through the common flow channel 3 at and near the bottom of the liquid chamber 6.

On the other hand, liquid flow (the second flow) B is formed so as to be directed from the liquid chamber 6 to the common flow channel 3 by way of the second introduction notch portion 56 at and near the second introduction port notch portion 56 that is formed at the downstream side of the introduction port. Swirling currents as illustrated in FIG. 10 are produced in the liquid chamber 6 due to the effects of the first flow A and the second flow B.

Generally, the liquid in the liquid chamber is heated by the sub-heaters of the recording element substrate in a recording standby status during a temperature control operation so that a high temperature region is formed in the liquid in the liquid chamber. On the other hand, with the arrangement of the present invention, the liquid in the common flow channel 3 is forced to circulate when no liquid is ejected from the liquid ejection head and hence the liquid in the liquid chamber 6 is stirred by swirling currents as described above so that a high temperature region can hardly be formed in the liquid in the liquid chamber 6. Therefore, the temperature of the liquid that is supplied to the recording element substrate 1 can be held low at the time of starting an image recording operation. In other words, due to the effect of the first and second branch port notch portions 51 and 52, swirling currents are produced in the liquid chamber 6 by utilizing the liquid flowing through the common flow channel 3 to promote the effect of stirring the liquid in the liquid chamber 6 and reduce the temperature difference in the liquid in a recording standby status during a temperature control operation.

When the liquid chamber 6 has a relatively large size, the liquid in the liquid chamber 6 is stirred by natural convection in the liquid chamber 6 to provide a stirring effect similar to that of the present invention. If such is the case, however, the liquid stirring effect in the liquid chamber 6 can be intensified by employing the above-described arrangement of the present invention to prevent a high temperature region from being produced in the liquid in the liquid chamber 6.

The advantages of the present invention were verified by way of numerical analysis simulations.

In Example 1, a liquid ejection head 5 (line head) as illustrated in FIG. 1 that was configured by employing support members 4 having a structure as illustrated in FIGS. 7A and 7B was connected to a temperature control tank 22, a circulation pump 19 and so on as illustrated in FIG. 6 and held in a recording standby status, while driving the liquid ejection head to operate and control the temperature of the liquid in the liquid ejection head 5.

Figure 11A:
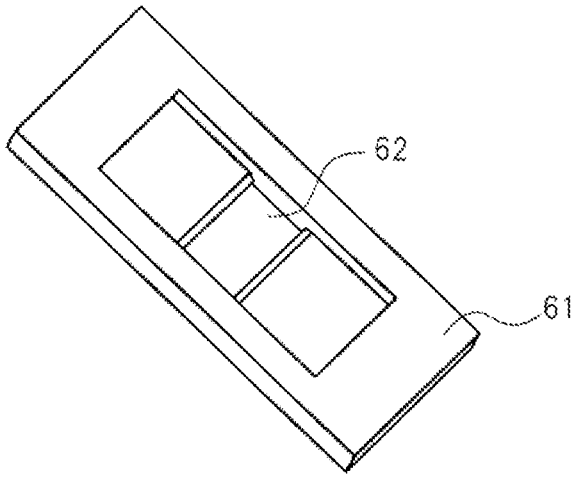
FIGS. 11A and 11B are schematic perspective views of one of the support members of Comparative Example 1.
Figure 11B:
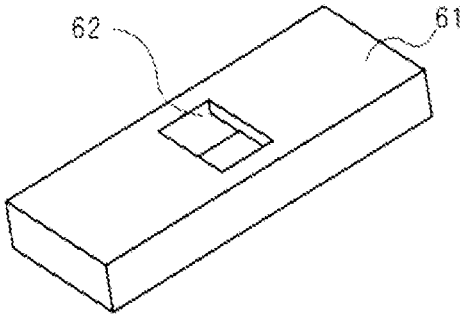

In Comparative Example 1, a liquid ejection head which is the same as that of Example 1 except that support members 61, each having an introduction port 62 that was not provided with notch portions as illustrated in FIGS. 11A and 11B were employed was prepared and subjected to a numerical analysis simulation. Note that FIG. 11A is a schematic perspective view of a support member 61 as viewed from the side of the recording element substrate and FIG. 11B is a schematic perspective view of the support member 61 as viewed from the side of the base substrate.

Both in Example 1 and Comparative Example 1, the distribution ports and the introduction ports were made to represent the same profiles. More specifically, although not illustrated, first and second distribution port notch portions 53 and 54 are formed in the distribution port 18 of the base substrate 2. To reduce the temperature differences among the recording element substrates, in each of the support members, the opening area of the introduction port is made to be equal to 25% of the contact area of the support member and the base substrate to suppress the quantity of heat that is conducted from each of the recording element substrates to the base substrate.

For the simulations, the rate at which liquid is circulated through the common flow channel was made to be equal to 25 mL/min and the temperature of each of the recording element substrates was so controlled as to be made equal to 55° C. Other conditions used for the calculations in the numerical analyses include supplied electric power per recording element substrate: 22.5 (W), recording speed: 18 (inch/s), ejected liquid droplet size: 2.8 (pL), image resolution: 1,200 (dpi) and supplied liquid temperature: 27 (° C.).

In Example 1, the average liquid volume at not lower than 40° C. in each of the liquid chambers 6 in a recording standby status during a temperature control operation was 0.39 mL. In Comparative Example 1, on the other hand, the average liquid volume at not lower than 40° C. in each of the liquid chambers 6 in a recording standby status during a temperature control operation was 0.41 mL. The average liquid volume in each of the liquid chambers 6 at not lower than 40° C. was smaller in Example 1 than in Comparative Example 1. It may be safe to say that this was because the liquid in each of the liquid chambers of Example 1 was stirred due to the operational effect of the notch portions.

Figure 12:
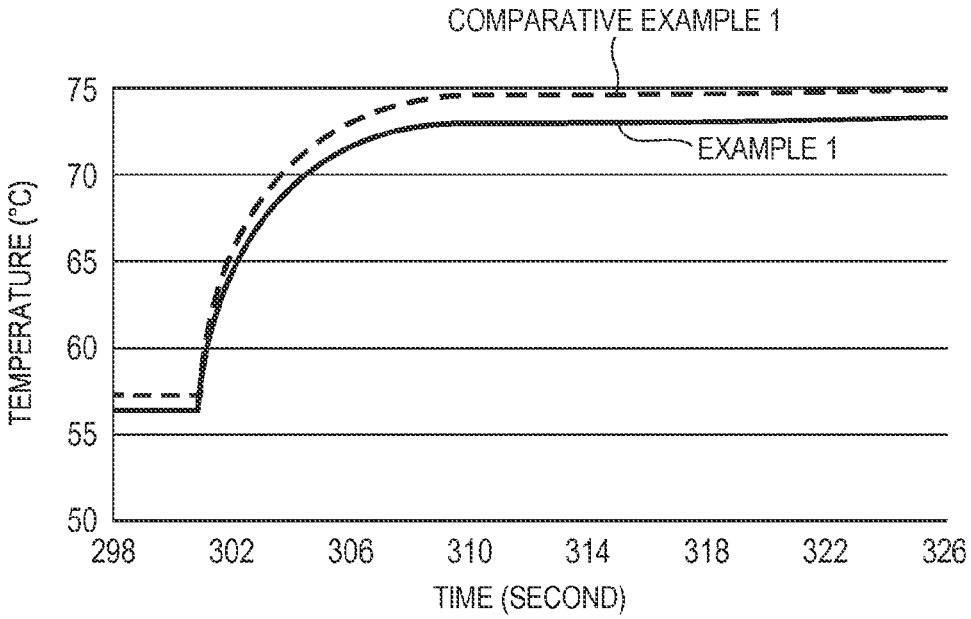
FIG. 12 is a graph illustrating the change with time of the highest temperature in the ejection port of the recording element substrate located at the downstream end side of the common flow channel that was observed in Example 1 and also in Comparative Example 1.

In each of the liquid ejection heads of Example 1 and Comparative Example 1, the recording element substrates were held in a recording standby status for 30 seconds during a temperature control operation and subsequently the liquid ejection head was driven to record a 100% solid image. FIG. 12 illustrates the change with time of the highest temperature in the ejection port of the recording element substrate located at the most downstream side of the common flow channel 3 in Example 1 and Comparative Example 1. As seen from FIG. 12, the highest temperature in the ejection port was lower in Example 1 than in Comparative Example 1 after the start of the image recording operation.

In Example 2, a liquid ejection head 5 (line head) which is the same as that of Example 1 was prepared except that support members 4, each having four liquid chambers as illustrated in FIG. 9B, were employed to form the liquid ejection head 5. In Comparative Example 2, a liquid ejection head 5 which is the same as that of Example 2 was prepared except that no notch portion was provided. Both the liquid ejection head 5 of Example 2 and that of Comparative Example 2 were subjected to a numerical analysis simulation. The conditions used for the calculations in the numerical analyses were the same as those of Example 1, which are described above.

Figure 13:
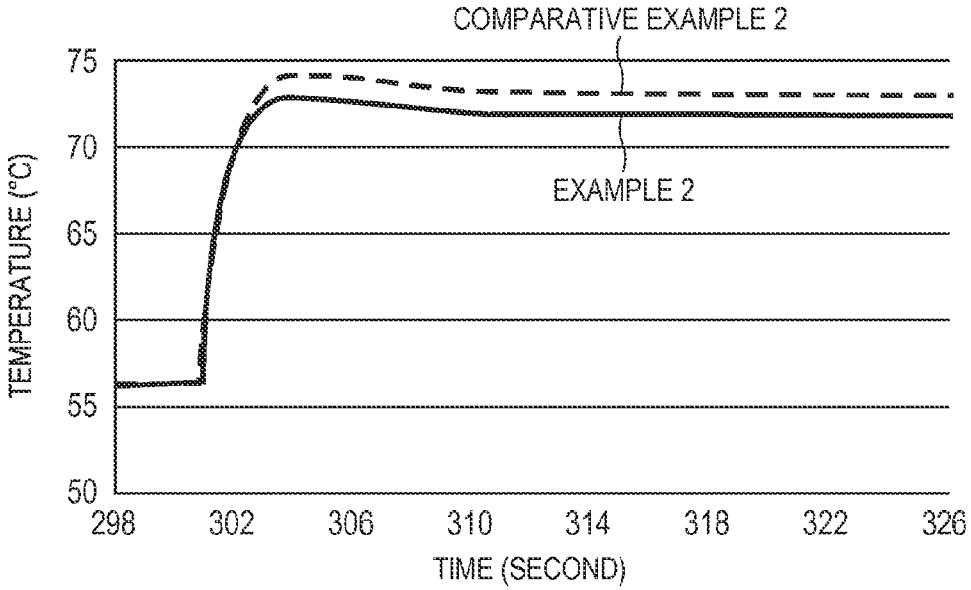
FIG. 13 is a graph illustrating the change with time of the highest temperature in the ejection port of the recording element substrate located at the downstream end side of the common flow channel that was observed in Example 2 and also in Comparative Example 2.

In each of Example 2 and Comparative Example 2, the recording element substrates were held in a recording standby status for 300 seconds during a temperature control operation and subsequently the liquid ejection head was driven to record a 100% solid image. FIG. 13 illustrates the change with time of the highest temperature in the ejection port of the recording element substrate located at the most downstream side of the common flow channel 3 in Example 2 and Comparative Example 2. As seen from FIG. 13, the highest temperature in the ejection port was lower in Example 2 than in Comparative Example 2 after the start of the image recording operation.

As seen from the above description, a liquid ejection head according to the present invention suppresses the temperature rise of each of the recording element substrates after the start of an image recording operation when a temperature control operation is conducted for each of the recording element substrates 1 while it is held in a recording standby status. The net result is that the liquid ejection head can reliably operate for high speed image recording without image irregularities.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-196837, filed Sep. 24, 2013, which is hereby incorporated by reference herein in its entirety.

What is claimed is:

1. A liquid ejection head comprising:

a plurality of ejection members, each having an ejection port for ejecting liquid, an element for ejecting liquid from the ejection port, a liquid chamber for storing liquid to be supplied to the ejection port, and a heater for heating liquid; and a base substrate supporting the plurality of ejection members arranged thereon and having a common flow channel for supplying liquid to the plurality of liquid chambers, wherein the common flow channel communicates with the liquid chambers by way of respective branch ports and an opening portion of each of the branch ports fronting the common flow channel is provided with a first notch portion at an upstream side thereof with respect to a flow direction of liquid flowing through the common flow channel, and the upstream side of each of the opening portions has a profile asymmetric with regard to a plane passing through the center of gravity of the opening portion, extending in the flow direction, and being orthogonal to a surface of the opening portion.

2. The liquid ejection head according to claim 1, wherein each of the branch ports is provided with a second notch portion, that is different from the first notch portion, at a downstream side thereof with respect to the flow direction of liquid flowing through the common flow channel.

3. The liquid ejection head according to claim 2, wherein the first notch portion and the second notch portion of each of the branch ports are arranged at respective ends of the upstream and downstream sides of the branch port with respect to a direction orthogonal to the flow direction of liquid flowing through the common flow channel.

4. The liquid ejection head according to claim 2, wherein the first notch portion and the second notch portion of each of the branch ports are arranged at the same position on the upstream and downstream sides, respectively, of the branch port with respect to the direction orthogonal to the flow direction of liquid flowing through the common flow channel.

5. The liquid ejection head according to claim 2, wherein the first notch portion and the second notch portion of each of the branch ports are arranged at different positions on the upstream and downstream sides, respectively, of the branch port with respect to the direction orthogonal to the flow direction of liquid flowing through the common flow channel.

6. The liquid ejection head according to claim 2, wherein the first notch portion and the second notch portion of each of the branch ports have profiles produced by notching the upstream and downstream sides, respectively, of the branch port.

7. The liquid ejection head according to claim 2, wherein the first notch portion and the second notch portion of each of the branch ports have profiles produced by inclining all the upstream and downstream sides, respectively, of the branch port from the direction orthogonal to the flow direction of liquid flowing through the common flow channel.

8. The liquid ejection head according to claim 2, wherein the first notch portion and the second notch portion of each of the branch ports have respective parts which are extensions from a lateral wall of the liquid chamber.

9. The liquid ejection head according to claim 1, wherein each of the branch ports is produced as an introduction port formed at a corresponding one of the ejection members so as to communicate with the corresponding liquid chamber and supply liquid to the corresponding ejection port and a distribution port formed at the base substrate so as to communicate with the common flow channel, the introduction port and the distribution port being configured to communicate with each other.

10. The liquid ejection head according to claim 1, wherein each of the ejection members has a recording element substrate and a support member, the ejection port of the ejection member is formed at the recording element substrate while the liquid chamber of the ejection member is formed in the support member, the recording element substrate is provided with a liquid supply port for supplying liquid from the liquid chamber to the ejection port, and the thermal resistance of the support member is not less than 2.5 (K/W).

11. A liquid ejection head comprising:

a plurality of ejection members, each having an ejection port for ejecting liquid, an element for ejecting liquid from the ejection port, a liquid chamber for storing liquid to be supplied to the ejection port and a heater; and a support member supporting the plurality of ejection members and having a common flow channel for supplying liquid to the plurality of ejection members, wherein the common flow channel communicates with the liquid chambers by way of respective openings, an opening portion of each of the openings fronting the common flow channel is provided with a notch portion at an upstream side thereof with respect to a flow direction of liquid flowing through the common flow channel, and the upstream side of each of the opening portions has a profile asymmetric with regard to a plane passing through the center of gravity of the opening portion, extending in the flow direction, and being orthogonal to a surface of the opening portion.

12. The liquid ejection head according to claim 11, wherein the notch portion of each of the opening portions is arranged at least at an end of the upstream side of the opening portion with respect to a direction orthogonal to the flow direction of liquid flowing through the common flow channel.

13. The liquid ejection head according to claim 11, wherein the plurality of ejection members are arranged along the common flow channel.

14. The liquid ejection head according to claim 11, wherein a second notch portion is formed at a downstream side of each of the opening portions with respect to the flow direction of liquid flowing through the common flow channel.

15. A liquid ejection head comprising:

a plurality of ejection members, each having an ejection port for ejecting liquid, a liquid chamber for storing liquid to be supplied to the ejection port, and a heater for heating liquid; and a support member supporting the plurality of ejection members and having a common flow channel for supplying liquid to the plurality of ejection members, wherein the common flow channel communicates with the liquid chambers by way of respective openings, and an opening portion of each of the openings fronting the common flow channel has an upstream side with respect to a flow direction of liquid flowing through the common flow channel, the upstream side having a profile asymmetric with regard to a plane passing through the center of gravity of the opening portion, extending in the flow direction, and being orthogonal to a surface of the opening portion.

16. The liquid ejection head according to claim 15, wherein a cutout portion is formed at the upstream side of each of the opening portions.

17. The liquid ejection head according to claim 15, wherein the plurality of ejection members are arranged along the common flow channel.

18. The liquid ejection head according to claim 15, wherein a cutout portion is formed at a downstream side of each of the opening portions with respect to the flow direction of liquid flowing through the common flow channel.

* * * * *